US009219342B2

(12) United States Patent
Liao et al.

(10) Patent No.: US 9,219,342 B2
(45) Date of Patent: Dec. 22, 2015

(54) CRIMPING TOOL

(71) Applicant: HANLONG INDUSTRIAL CO., LTD., New Taipei (TW)

(72) Inventors: Chien-Chou Liao, New Taipei (TW); Hsing-Chieh Ho, New Taipei (TW)

(73) Assignee: Hanlong Industrial Co., Ltd., New Taipei (TW)

( * ) Notice: Subject to any disclaimer, the term of this patent is extended or adjusted under 35 U.S.C. 154(b) by 262 days.

(21) Appl. No.: 13/897,491

(22) Filed: May 20, 2013

(65) Prior Publication Data

US 2014/0245807 A1 Sep. 4, 2014

(30) Foreign Application Priority Data

Mar. 1, 2013 (TW) ..... 102203869 U

(51) Int. Cl.
*H01R 43/042* (2006.01)

(52) U.S. Cl.
CPC ..... *H01R 43/0425* (2013.01)

(58) Field of Classification Search
CPC ..... H01R 43/042; H01R 43/045; H01R 43/0428; B25B 7/12; B25B 27/146; B21D 39/04
See application file for complete search history.

(56) References Cited

U.S. PATENT DOCUMENTS

| | | | | |
|---|---|---|---|---|
| 2,713,279 | A * | 7/1955 | Harris | 72/409.01 |
| 3,859,837 | A * | 1/1975 | Burroughs | 72/409.12 |
| 5,012,666 | A * | 5/1991 | Chen et al. | 72/409.01 |
| 8,006,537 | B2 * | 8/2011 | Liu | 72/409.14 |

* cited by examiner

*Primary Examiner* — Teresa M Ekiert
(74) *Attorney, Agent, or Firm* — Alan D. Kamrath; Kamrath IP Lawfirm, P.A.

(57) ABSTRACT

A crimping tool includes a first rod, a second rod, a transmission unit and a crimping portion. The first rod includes a first rod body. The second rod includes a second rod body and an abutting element, and the second rod body includes a guiding groove. The transmission unit includes a transmission unit body, an adjustable portion, a sliding element and a linking element, and the adjustable portion is disposed on one end of the transmission unit body, which is external to the second rod body. The crimping portion is connected with the transmission unit body. When the crimping tool is used, the adjustable portion can be adjusted, and, thus, the crimping portion is moved, thereby changing the distance between the crimping portion and the abutting element.

12 Claims, 13 Drawing Sheets

CRIMPING TOOL

FIELD

The exemplary embodiments of the present invention relate to a crimping tool. More specifically, the exemplary embodiments of the present invention relate to a crimping tool which can crimp coaxial connectors and signal lines having different specifications.

BACKGROUND

Crimping different types of coaxial connectors (such as the F-type coaxial connector or BNC-type coaxial connector) or the same type coaxial connector but having different specifications (for example, different lengths) requires different crimping tools. Though there is a crimping tool equipped with a detachable coaxial connector crimping member for coaxial connectors having different types or specifications, there are still some disadvantages.

Please refer to FIG. 1, which is a schematic diagram of one prior art related to the present invention. The sliding element 33*a* of the crimping tool 1*a* is disposed inside the base 20*a* of the crimping tool 1*a*. By adjusting the adjustable portion 32*a*, the relative connection length between the adjustable portion 32*a* and the sliding element 33*a* can be adjusted, thereby changing the connection length to fit coaxial connectors having different lengths. However, because the adjustable portion 32*a* is disposed between the upper rod body and the lower rod body and inside the base 20*a*, it is not convenient to the user to operate.

Please refer to FIG. 2, which is a schematic diagram of another prior art related to the present invention. The crimping tool 1*b* can also be used for crimping coaxial connectors having different lengths. Even though the adjustable portion 32*b* is not disposed inside the base 20*b*, it is still disposed between the upper rod body and the lower rod body. The whole structure is very complicated and has a high manufacturing cost, and it is still not convenient to the user to operate.

Therefore, it is necessary to provide a crimping tool which can be adjusted quickly, has a simple structure, and has a low manufacturing cost to improve the problems existing in the prior arts.

Therefore, it is necessary to provide a crimping tool which can be adjusted quickly, has a simple structure, and has a low manufacturing cost so as to improve the problems existing in the prior arts.

SUMMARY

The main object of the present invention is to provide a crimping tool for crimping signal lines and coaxial connectors.

According to one embodiment of the present invention, the crimping tool of the present invention comprises a first rod, a second rod, a transmission unit and a crimping portion. The first rod includes a first rod body. The second rod includes a second rod body and an abutting element. One end of the second rod body is pivotally connected with the first rod body, the abutting element is disposed on another end of the second rod body, and the second rod body includes a guiding groove. The transmission unit comprises a transmission unit body, an adjustable portion, a sliding element and a linking element. The transmission unit body is extended through the end of the second rod body pivotally connected to the first rod body. The sliding element is connected with the transmission unit body and is able to move on the transmission unit body, bumps are disposed on the left side and the right side of the sliding element, and the sliding element is slidably connected with the guiding groove through the bumps. The adjustable portion is disposed on one end of the transmission unit body, which is external to the second rod body. One end of the linking element is pivotally connected with the first rod body, and another end of the linking element is pivotally connected with sliding element through the bumps. The crimping portion is connected with the transmission unit body. Therefore, when the crimping tool is used, the adjustable portion can be adjusted, and, thus, the crimping portion is moved, thereby changing the distance between the crimping portion and the abutting element.

According to one embodiment of the present invention, the transmission unit body comprises a screw rod, the sliding element comprises a first threaded hole, and the sliding element is spirally connected with the transmission unit body by extending the screw rod through the first threaded hole.

According to one embodiment of the present invention, the crimping portion comprises a second threaded hole, and the crimping portion is spirally connected with the transmission unit body by extending the screw rod through the second threaded hole.

According to one embodiment of the present invention, the crimping tool further comprises an elastic element pivotally connected with the linking element, and the elastic element provides an elastic force for returning the first rod body and the second rod body to the original position after the first rod body and the second rod body are pressed together.

According to one embodiment of the present invention, the left side and the right side of the sliding element each include two bumps, the sliding element is slidably connected with the guiding groove through one of the two bumps, and the linking element is pivotally connected with the sliding element through the other bump.

According to one embodiment of the present invention, the type of the crimping portion is an F-type coaxial connector crimping portion, a BNC-type coaxial connector crimping portion, an RCA-type coaxial connector crimping portion or an IEC-type coaxial connector crimping portion.

According to one embodiment of the present invention, the crimping portion and the transmission unit body are integrally formed.

According to one embodiment of the present invention, the crimping portion is detachably connected with the transmission unit body.

According to one embodiment of the present invention, the sliding element is substantially cylindrical.

According to one embodiment of the present invention, the second rod further comprises a buckle, and the buckle is pivotally connected with the second rod body for buckling the first rod and the second rod.

According to one embodiment of the present invention, the crimping tool of the present invention comprises a first rod, a second rod, a transmission unit and a crimping portion. The first rod includes two first rod bodies. The second rod includes a second rod body and an abutting element, the second rod body includes two guiding grooves, a first end and a second end, and the abutting element is disposed on the first end of the second rod body. The transmission unit comprises a transmission unit body, a sliding element, an adjustable portion and two linking elements. The transmission unit body is extended through the second end of the second rod body. The sliding element is connected with the transmission unit body and is able to move on the transmission unit body. The sliding element includes two bumps, the sliding element is slidably connected with the two guiding grooves through the two bumps, and the two first rod bodies are connected with the sliding element through the two bumps. The adjustable portion is disposed on one end of the transmission unit body, and the one end is external to the second rod body. One end of each of the two linking elements is pivotally connected with the two first rod bodies, and another end of each of the two linking elements is pivotally connected with the second rod body respectively. The crimping portion is connected with the transmission unit body. Therefore, when the crimping tool is used, the adjustable portion can be adjusted, and, thus, the crimping portion is moved, thereby changing the distance between the crimping portion and the abutting element.

According to one embodiment of the present invention, the crimping tool of the present invention comprises a first rod, a second rod, a transmission unit and a crimping portion. The first rod includes a first rod body. The second rod includes a second rod body and an abutting element. One end of the second rod body is pivotally connected with the first rod body, and the abutting element is disposed on another end of the second rod body. The transmission unit comprises a transmission unit body, a sliding element, an adjustable portion and a linking element. The transmission unit body is extended through the end of the second rod body pivotally connected to the first rod body. The sliding element is connected with the transmission unit body and is able to move on the transmission unit body. The adjustable portion is disposed on one end of the transmission unit body, which is external to the second rod body. One end of the linking element is pivotally connected with the first rod body, and another end of the linking element is pivotally connected with the transmission unit body. The crimping portion is connected with the transmission unit body. Therefore, when the crimping tool is used, the adjustable portion can be adjusted, and, thus, the crimping portion is moved, thereby changing the distance between the crimping portion and the abutting element.

BRIEF DESCRIPTION OF THE DRAWINGS

The exemplary embodiments of the present invention will be understood more fully from the detailed description given below and from the accompanying drawings of various embodiments of the invention, which, however, should not be taken to limit the invention to the specific embodiments, but are for explanation and understanding only.

DETAILED DESCRIPTION

For facilitating understanding and clarifying the object, characteristics and advantages of the present invention, the following detailed descriptions of the specific embodiments and figures of the present invention are presented.

Please refer to FIG. 3 to FIG. 6 together, which present the crimping tool in accordance with the first embodiment of the present invention.

Figure 1:
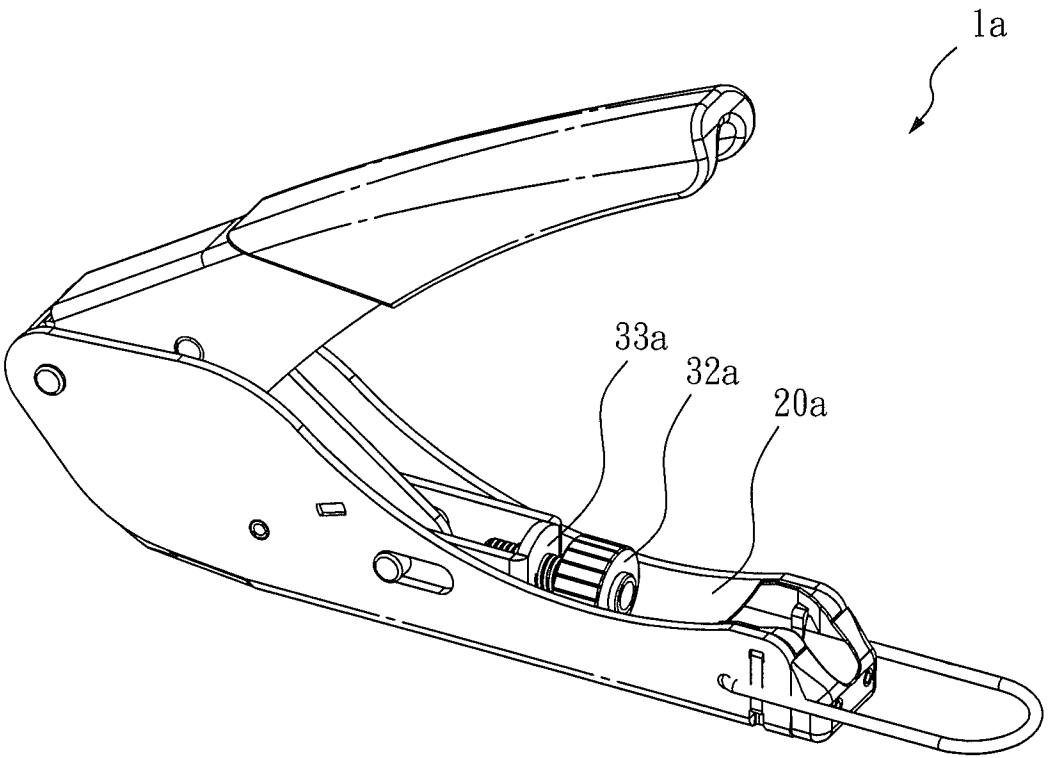
FIG. 1 (PRIOR ART)
FIG. 1 is a schematic diagram of one prior art related to the present invention.
Figure 2:
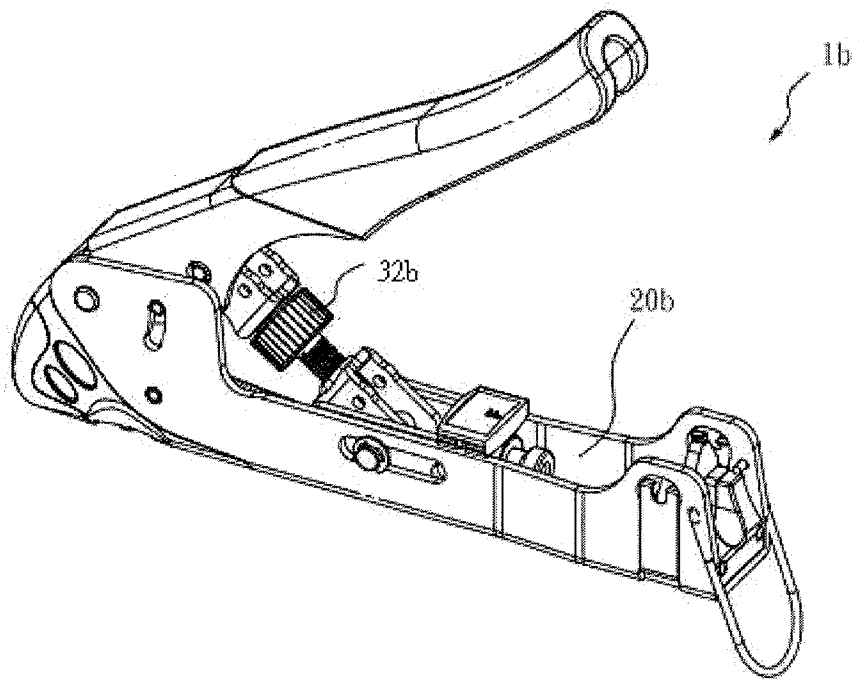
FIG. 2 (PRIOR ART)
FIG. 2 is a schematic diagram of another prior art related to the present invention.
Figure 3:
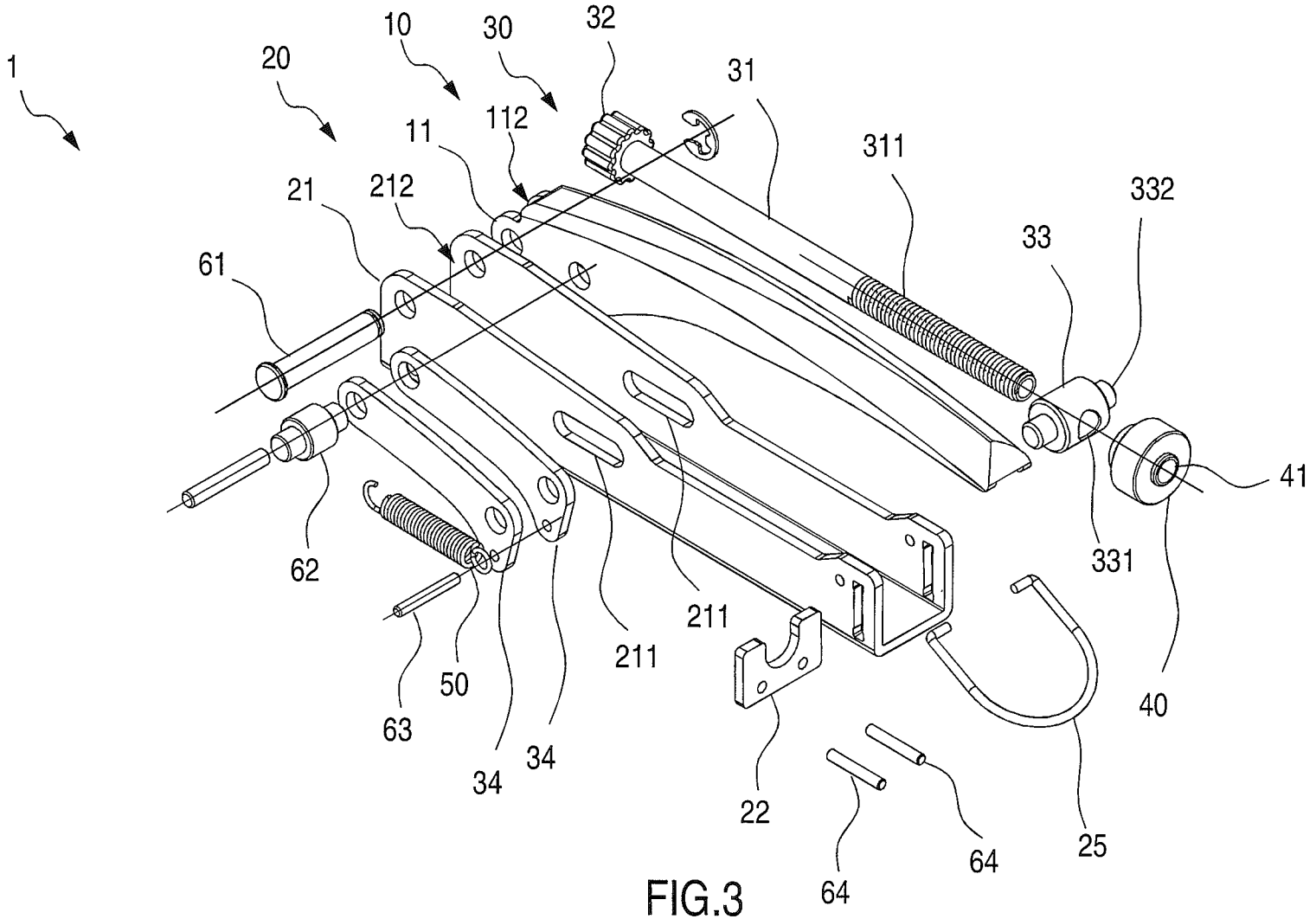
FIG. 3 is an exploded view diagram of the crimping tool in accordance with a first embodiment of the present invention.

As shown in FIG. 3, according to one embodiment of the present invention, the crimping tool 1 of the present invention comprises a first rod 10, a second rod 20, a transmission unit 30, a crimping portion 40 and an elastic element 50. According to one embodiment of the present invention, the first rod 10 and the second rod 20 are handles for a user to handle the crimping tool 1 directly. The shape of the second rod 20 is designed for being laid on a plane as a base, but the present invention is not limited to this example.

According to one embodiment of the present invention, as shown in FIG. 3, the first rod 10 includes a first rod body 11 defining a first opening 112. The second rod 20 includes a second rod body 21 defining a second opening 212, an abutting element 22 and a buckle 25.

According to one embodiment of the present invention, as shown in FIG. 3, one end of the second rod body 21 is pivotally connected with the first rod body 11 with the second opening 212 overlapping the first opening 112, the abutting element 22 is disposed on another end of the second rod body 21, and two guiding grooves 211 are included on the left and right side of the second rod body 21. According to one embodiment of the present invention, the shape of the guiding groove 211 is substantially long, but the present invention is not limited to this example. In addition, the second rod 20 further has a buckle 25 pivotally connected with the second rod body 21, and when the user does not want to use the crimping tool 1, the buckle 25 can be used to close the first rod 10 and the second rod 20. According to one embodiment of the present invention, the first rod 10 is integrally formed, but the present invention is not limited to this example. In addition, according to one embodiment of the present invention, the second rod body 21 and the abutting element 22 are separate devices, but the present invention is still not limited to this example.

According to one embodiment of the present invention, as shown in FIG. 3, the transmission unit 30 comprises a transmission unit body 31, an adjustable portion 32, a sliding element 33 and two linking elements 34. The transmission unit body 31 is extended through the second and first openings 212 and 112 of the second rod body 21 and the first rod body 11. The first end of the transmission unit body 31 is located outside the first and second openings 112 and 212 opposite to the end of the second rod body 21 on which the abutting element 22 is disposed. The bumps 332 are included on the left side and the right side of the sliding element 33, the sliding element 33 is adjustably connected with the transmission unit body 31, and the sliding element 33 is slidably connected with the guiding groove 211 through the bumps 332. The adjustable portion 32 is disposed on one end of the transmission unit body 31, which is external to the second rod body 21. One end of each of the two linking elements 34 is pivotally connected with the first rod body 11, and another end of each of the two linking elements 34 is pivotally connected with the sliding element 33 through the bumps 332. Also, it has to be noted that the number of the linking elements 34 is not limited to two.

According to one embodiment of the present invention, as shown in FIG. 3, the adjustable portion 32 is a cylindrical screw column, but the present invention is still not limited to this example. In addition, according to one embodiment of the present invention, the transmission unit body 31 comprises a screw rod 311, the sliding element 33 comprises a first threaded hole 331, and the sliding element 33 is spirally adjustably connected with the transmission unit body 31 by extending the screw rod 311 through the first threaded hole 331. Therefore, the sliding element 33 is able to move on the transmission unit body 31, but the present invention is still not limited to this connection type. According to one embodiment of the present invention, the sliding element 33 is substantially cylindrical, but the present invention is still not limited to this example. The sliding element 33 is slidably adjustably connected with the guiding groove 211 through the bumps 332. Thus, the sliding element 33 is able to slide in the guiding groove 211, and the guiding groove 211 provides a position limiting function to the sliding element 33. According to one embodiment of the present invention, the linking element 34 is a connecting rod structure, but the present invention is still not limited to this example.

According to one embodiment of the present invention, as shown in FIG. 3, the crimping portion 40 is connected with the transmission unit body 31. In addition, according to one embodiment of the present invention, the crimping portion 40 comprises a second threaded hole 41, and the crimping portion 40 is spirally connected with the transmission unit body 31 by extending the screw rod 311 through the second threaded hole 41.

According to one embodiment of the present invention, as shown in FIG. 3, the elastic element 50 is pivotally connected with the linking element 34. The elastic element 50 provides an elastic force. When the user presses the first rod 10 and the second rod 20 to close them, force is applied to the elastic element 50, and the elastic force is stored. Thus, when the user releases the force, the elastic force stored in the elastic element 50 will cause the first rod 10 and the second rod 20 to return to the original position, and the type and the position of the elastic element 50 are not limited here.

According to one embodiment of the present invention, as shown in FIG. 3, the elastic element 50 is pivotally connected with the linking elements 34 through the third pivot 63. The first rod body 11 is pivotally connected with the second rod body 21 through the first pivot 61. One end of each of the two linking elements 34 is pivotally connected with the first rod body 11 through the second pivot 62. The abutting element 22 is pivotally connected with one end of the second rod body 21 through two fourth pivots 64.

Figure 4A:
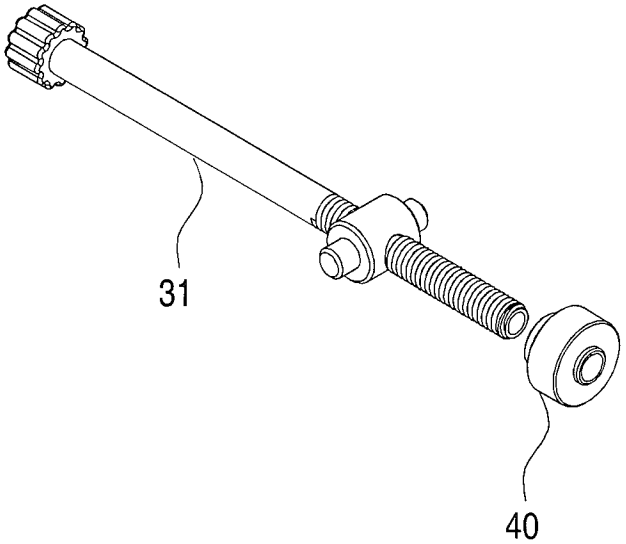
FIGS. 4A and 4B are schematic diagrams of the sliding element in accordance with the first embodiment of the present invention.
Figure 4B:
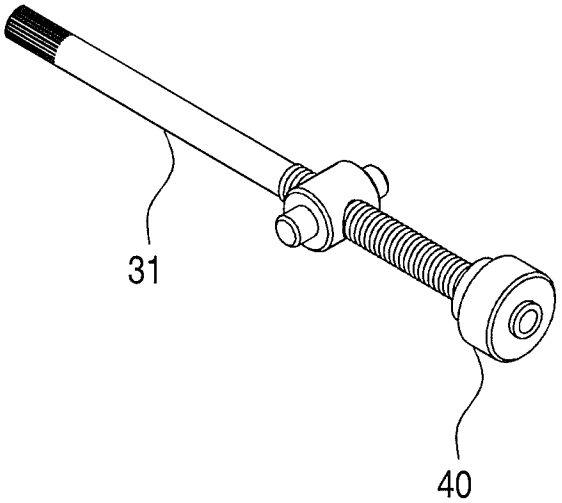
Figure 5:
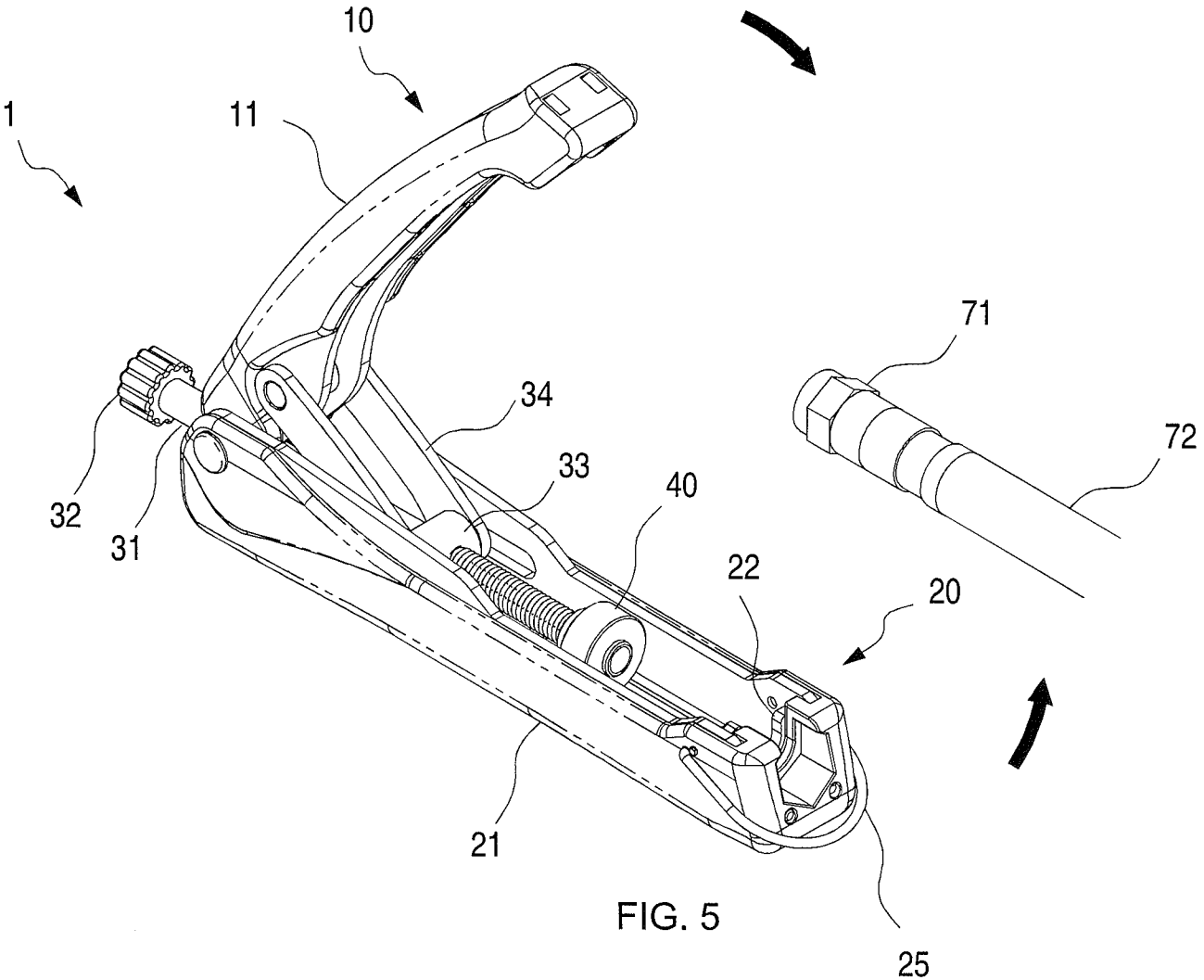
FIG. 5 is an operation schematic diagram of the crimping tool in accordance with the first embodiment of the present invention.

According to one embodiment of the present invention, as shown in FIG. 4A, the crimping portion 40 is detachably connected with the second end of the transmission unit body 31, but the present invention is not limited to this example. The crimping portion 40 is located intermediate the abutting element 22 and the first end of the transmission unit body 31. As shown in FIG. 4B, the crimping portion 40 and the transmission unit body 31 can also be integrally formed.

According to one embodiment of the present invention, when the user uses the crimping tool 1 of the present invention, first the coaxial connector 71 and the signal line 72 are put into the second rod body 21. After the user presses the first rod 10 and the second rod 20 to close them, each linking element 34 will push the sliding element 33 along the guiding groove 211 (please refer to FIG. 3) to move the crimping portion 40 toward the abutting element 22. Thus, the coaxial connector 71 and the signal line 72 will be crimped due to the pressure formed by the crimping portion 40 and the abutting element 22. When the user loosens his/her hand, the elastic element 50 (as shown in FIG. 3) will release the stored elastic force and thus make the first rod body 11 and the second rod body 21 return to the original position. It has to be noted here that the method of crimping executed by the crimping portion 40 and the abutting element 22 are widely used in the related field. Since it is not the point to be improved in the present invention, the details of the operation will not be described here. In addition, according to one embodiment of the present invention, in order to fit different coaxial connectors 71, such as an F-type coaxial connector, a BNC-type coaxial connector, an RCA-type coaxial connector or an IEC-type coaxial connector, the crimping portion 40 can be changed to a corresponding type, such as an F-type coaxial connector crimping portion, a BNC-type coaxial connector crimping portion, an RCA-type coaxial connector crimping portion or an IEC-type coaxial connector crimping portion.

Figure 6A:
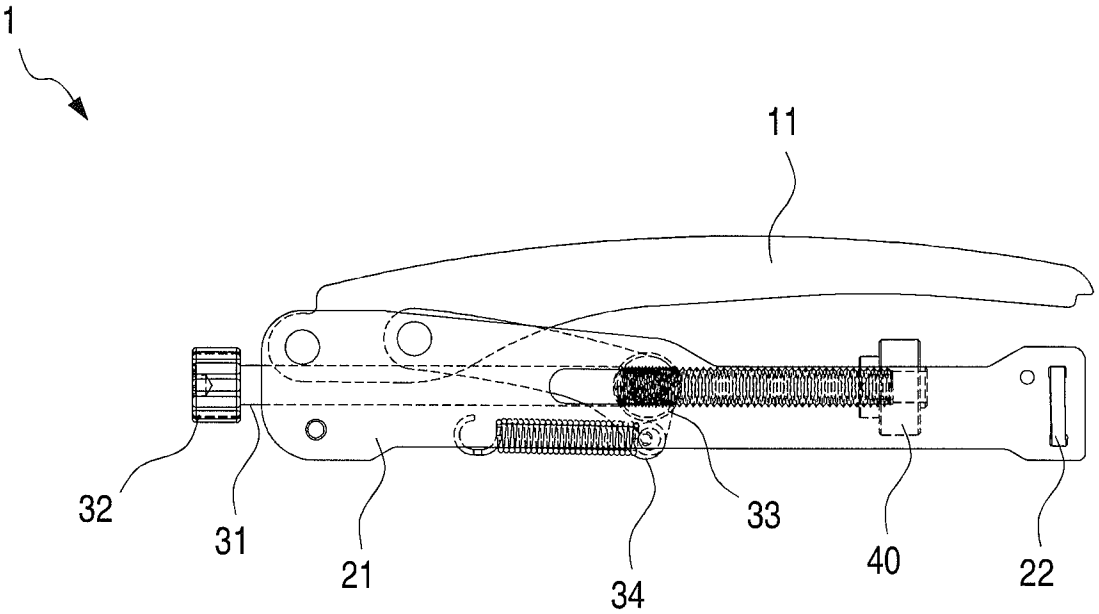
FIGS. 6A and 6B are schematic diagrams of adjusting the transmission unit in accordance with the first embodiment of the present invention.
Figure 6B:
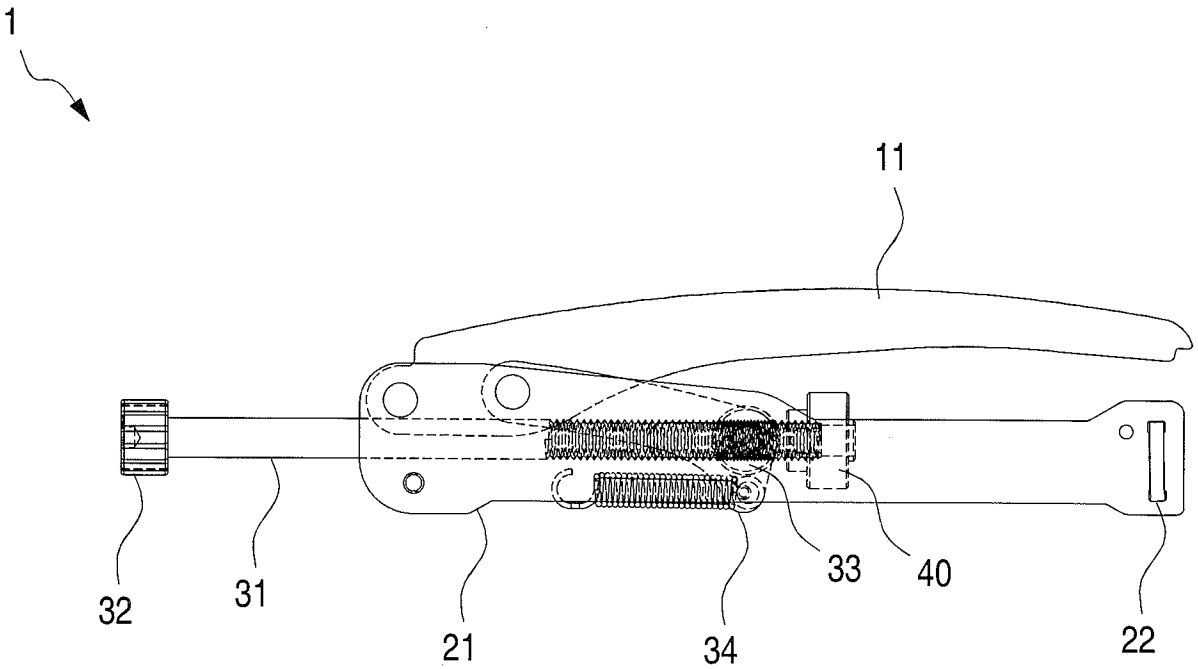

According to one embodiment of the present invention, as shown in FIGS. 6A and 6B, when the length of the coaxial connector is longer, the user can rotate the adjustable portion 32 and move the transmission unit body 31 backwardly and thus increase the distance between the crimping portion 40 and the abutting element 22. Furthermore, when the transmission unit body 31 moves backwardly, because the sliding element 33 is fixed by the linking elements 34 (please refer to FIG. 3), the transmission unit body 31 will move backwardly relative to the linking elements 34, and the crimping portion 40 will also move backwardly along with the transmission unit body 31. When the length of the coaxial connector is shorter, an adjustment similar to the above description can be performed. In addition, the adjustable portion 32 is disposed on one end of the transmission unit body 31, which is external to the second rod body 21. Unlike in the prior art, in which the adjustable portion is disposed inside the body, the user can easily adjust the adjustable portion 32 in the present invention.

It has to be noted here that according to another embodiment of the present invention, the transmission unit of the crimping tool can also be disposed in the first rod but is not limited to be extended through the second rod.

Figure 7:
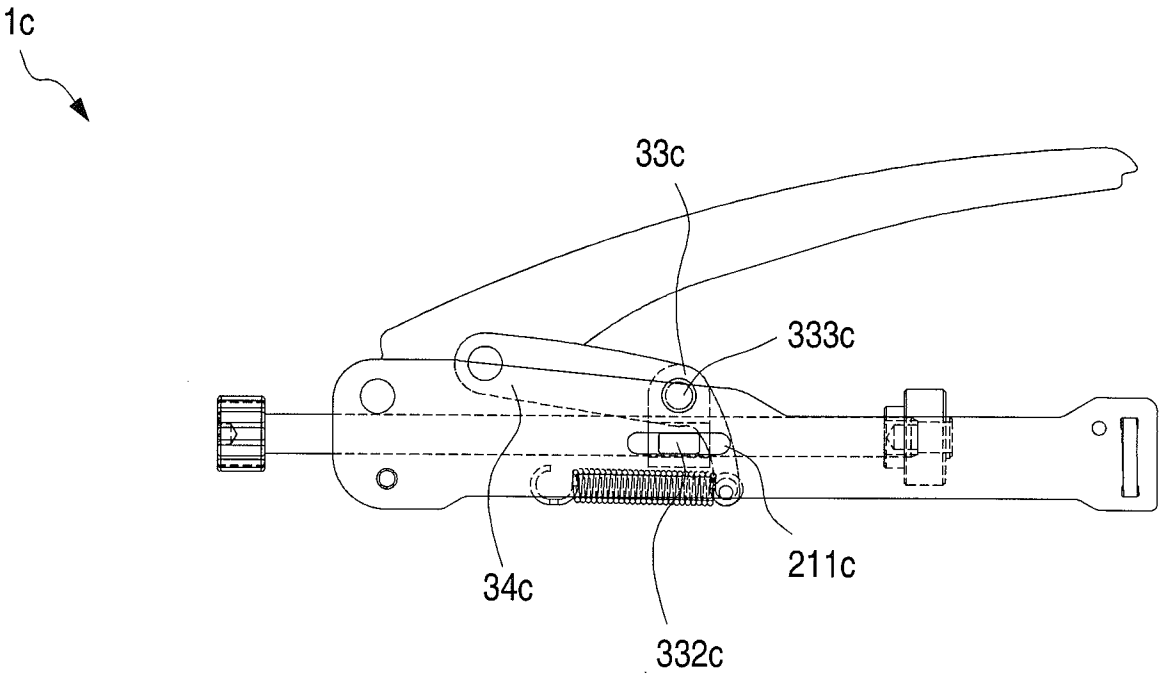
FIG. 7 is a schematic diagram of the crimping tool in accordance with a second embodiment of the present invention.

Next please refer to FIG. 7, which is a schematic diagram of the crimping tool in accordance with the second embodiment of the present invention. As shown in FIG. 7, two bumps 332*c* and 333*c* are included on the left side and the right side of the sliding element 33*c* of the crimping tool 1*c*, the sliding element 33*c* is slidably connected with the guiding groove 211*c* through the bump 332*c*, and the linking element 34*c* is pivotally connected with the sliding element 33*c* through the bump 333*c*.

Figure 8A:
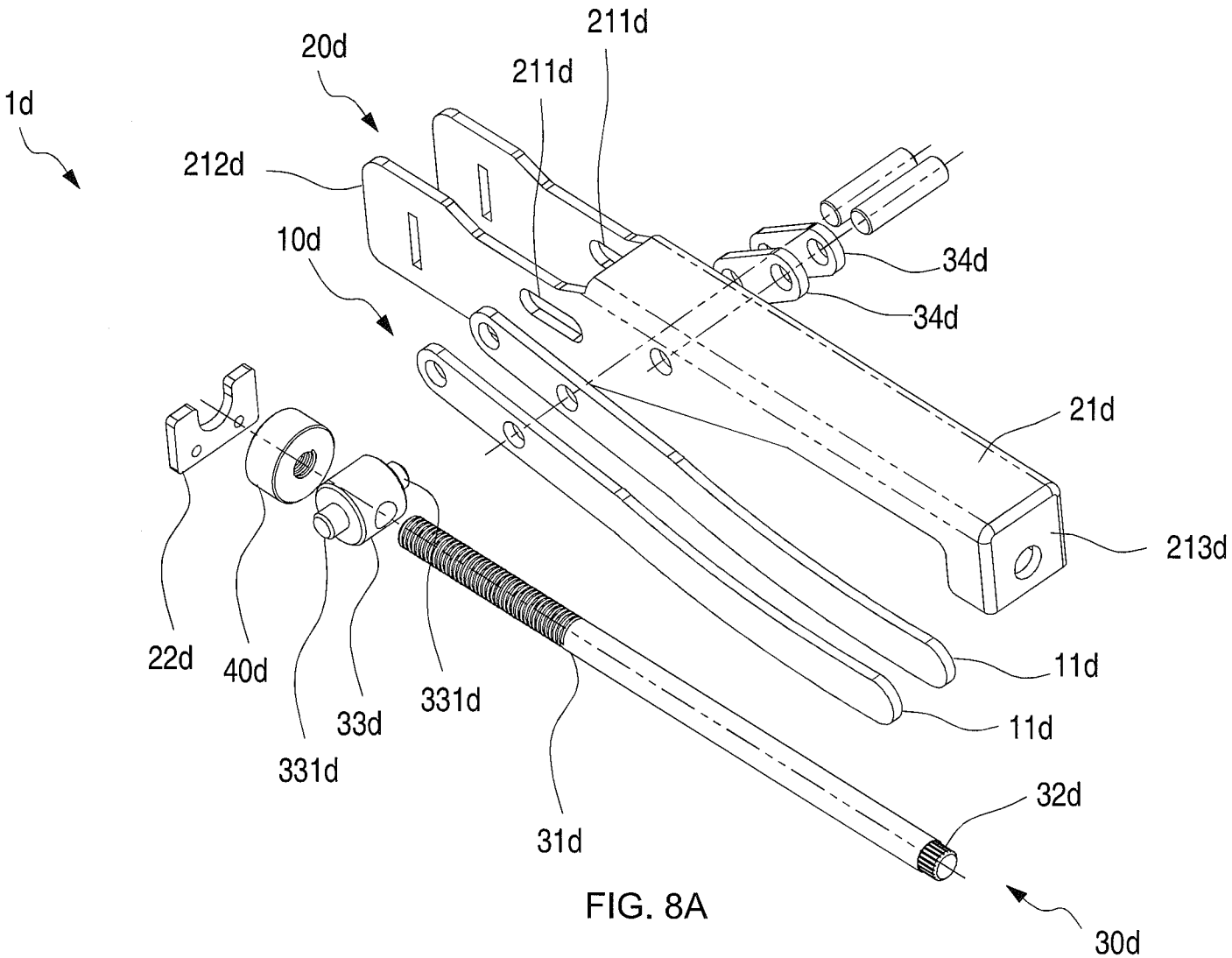
FIGS. 8A and 8B are schematic diagrams of the crimping tool in accordance with a third embodiment of the present invention.
Figure 8B:
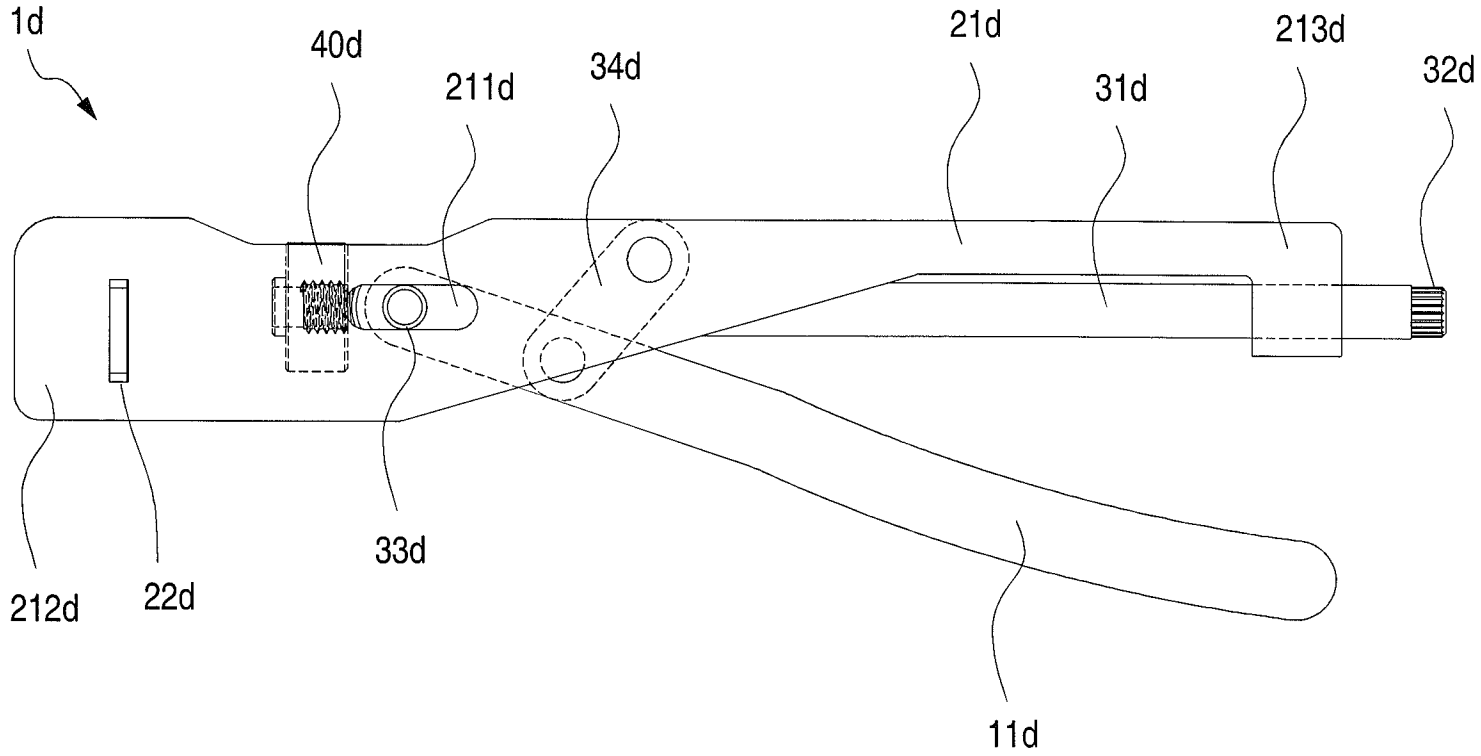

Next please refer to FIGS. 8A and 8B, which are schematic diagrams of the crimping tool in accordance with the third embodiment of the present invention. As shown in FIGS. 8A and 8B, the crimping tool 1*d* comprises a first rod 10*d*, a second rod 20*d*, a transmission unit 30*d* and a crimping portion 40*d*, and the first rod 10*d* includes two first rod bodies 11*d*. The second rod 20*d* includes a second rod body 21*d* and an abutting element 22*d*. The second rod body 21*d* includes two guiding grooves 211*d*, a first end 212*d* and a second end 213*d*, and the abutting element 22*d* is disposed on the first end 212*d* of the second rod body 21*d*.

According to one embodiment of the present invention, as shown in FIGS. 8A and 8B, the transmission unit 30*d* comprises a transmission unit body 31*d*, a sliding element 33*d*, an adjustable portion 32*d* and two linking elements 34*d*. The transmission unit body 31*d* is extended through the second end 213*d* of the second rod body 21*d*. The sliding element 33*d* is connected with the transmission unit body 31*d* and is able to move on the transmission unit body 31*d*. The sliding element 33*d* includes two bumps 331*d*, the sliding element 33*d* is slidably connected with the two guiding grooves 211*d* through the two bumps 331*d*, and the two first rod bodies 11*d* are connected with the sliding element 33*d* through the two bumps 331*d*. The adjustable portion 32*d* is disposed on one end of the transmission unit body 31*d*, which is external to the second rod body 21*d*. One end of each of the two linking elements 34*d* is pivotally connected with the two first rod bodies 11*d*, and another end of each of the two linking elements 34*d* is pivotally connected with second rod body 21*d* respectively. Finally, the crimping portion 40*d* is connected with the transmission unit body 31*d*. Because the adjustable portion 32*d* is external to the second rod body 21*d*, the user can easily adjust the adjustable portion 32*d* to move the crimping portion 40*d*, thereby changing the crimping distance between the abutting element 22*d* and the crimping portion 40*d*.

Figure 9A:
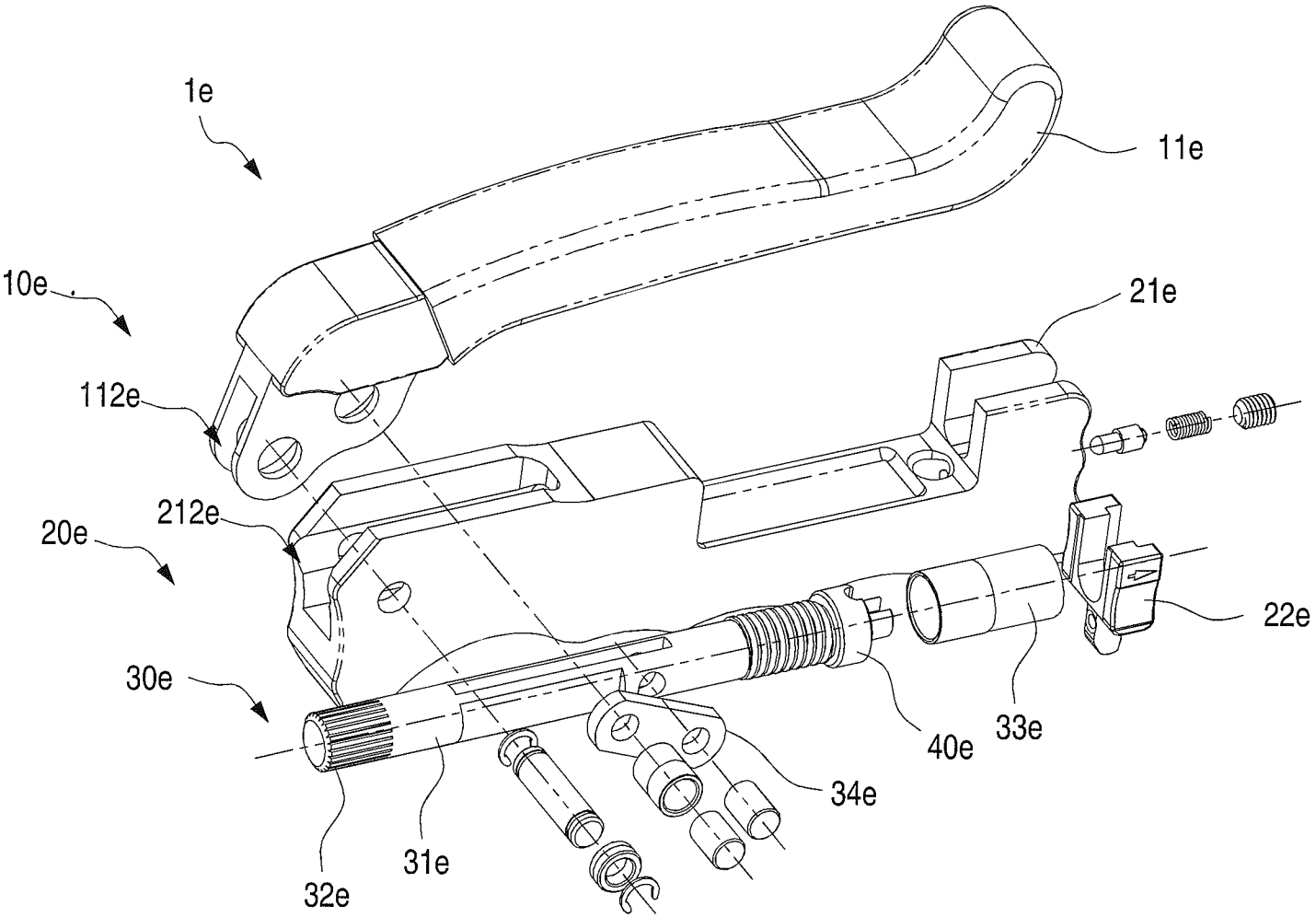
FIGS. 9A and 9B are schematic diagrams of the crimping tool in accordance with a fourth embodiment of the present invention.
Figure 9B:
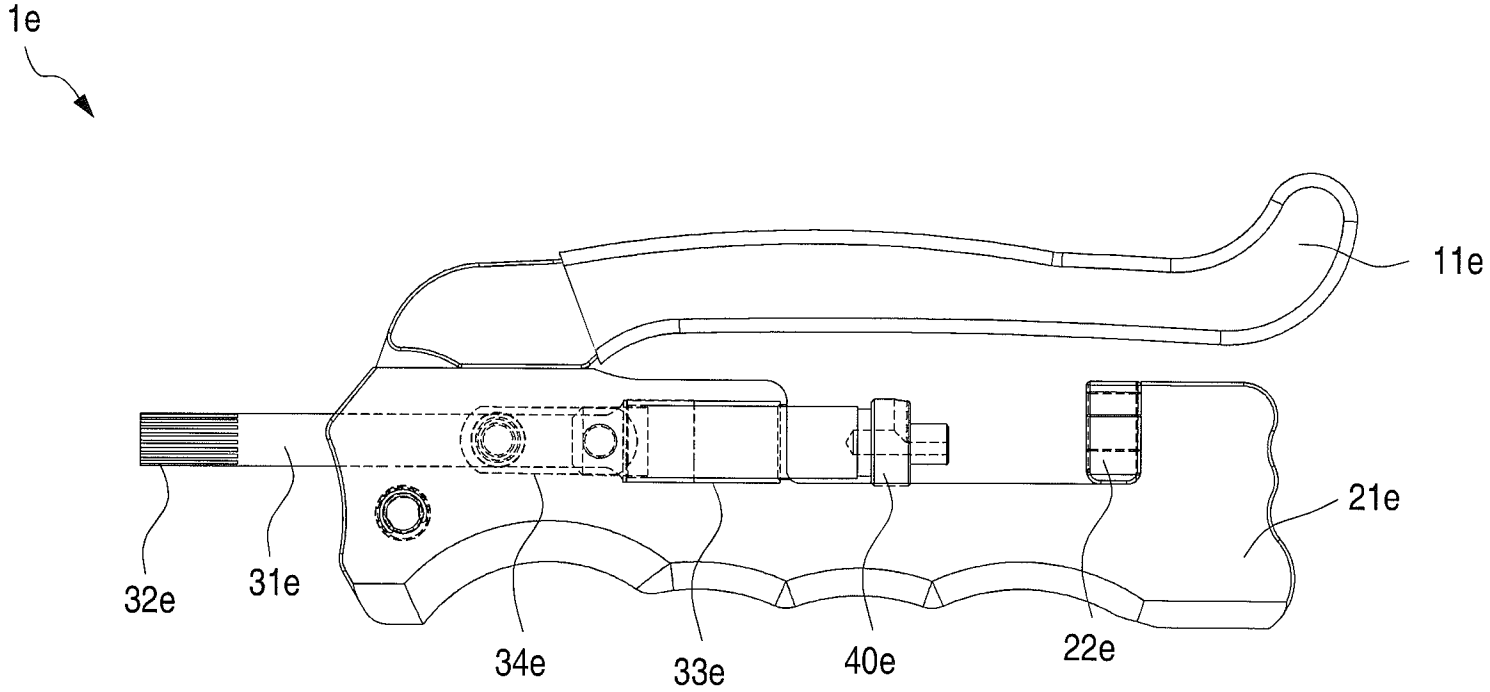

Next please refer to FIGS. 9A and 9B, which are schematic diagrams of the crimping tool in accordance with the fourth embodiment of the present invention. As shown in FIGS. 9A and 9B, the crimping tool 1*e* of the present invention comprises a first rod 10*e*, a second rod 20*e*, a transmission unit 30*e* and a crimping portion 4*e*. The first rod 10*e* includes a first rod body 11*e* defining a first opening 112*e*. The second rod 20*e* includes a second rod body 21*e* defining a second opening 212*e* and an abutting element 22*e*. One end of the second rod body 21*e* is pivotally connected with the first rod body 11*e*, and the abutting element 22*e* is disposed on another end of the second rod body 21*e*.

According to one embodiment of the present invention, as shown in FIGS. 9A and 9B, the transmission unit 30*e* comprises a transmission unit body 31*e*, a sliding element 33*e*, an adjustable portion 32*e* and a linking element 34*e*. The transmission unit body 31*e* is extended through the end of the second rod body 21*e* pivotally connected to the first rod body 11*e*. The sliding element 33*e* is connected with the transmission unit body 31*e* and is able to move on the transmission unit body 31*e*. The adjustable portion 32*e* is disposed on one end of the transmission unit body 31*e*, which is external to the second rod body 21*e*. One end of the linking element 34*e* is pivotally connected with the first rod body 11*e*, and another end of the linking element 34*e* is pivotally connected with the transmission unit body 31*e*. Final, the crimping portion 40*e* is connected with the transmission unit body 31*e*. Because the adjustable portion 32*e* is external to the second rod body 21*e*, the user can easily adjust the adjustable portion 32*e* to move the crimping portion 40*e*, thereby changing the crimping distance between the abutting element 22*e* and the crimping portion 40*e*.

In summary, regardless of the function, way and result, the present invention is shown to have technical characteristics different from those of the prior arts. However, the aforementioned embodiments are just for illustrating the principle and the result of the present invention and not for limiting the range of the present invention. It will be obvious to those skilled in the art that, based upon the descriptions herein, changes and modifications may be made without departing from this invention and its broader aspects. Therefore, the appended claims are intended to encompass within their scope all such changes and modifications as are within the true spirit and scope of the exemplary embodiments of the present invention.

What is claimed is:

1. A crimping tool comprising:

a first rod including a first rod body having a first end defining a first opening;

a second rod including a second rod body and an abutting element, with a first end of the second rod body pivotally connected with the first rod body, with the first end of the second rod body including a second opening overlapping the first opening, with the abutting element disposed on a second end of the second rod body opposite to the first end of the second rod body, and with the second rod body including at least one guiding groove;

a transmission unit comprising:

a transmission unit body having a first end and a second end, with the transmission unit body extended through the second and first openings of the second rod body and the first rod body, with the first end of the transmission unit body located outside the first and second openings opposite to the second end of the second rod body;

a sliding element adjustably connected with the transmission unit body and moveable on the transmission unit body, with the sliding element including at least one bump slidably connected with the at least one guiding groove; and an adjustable portion disposed on the first end of the transmission unit body, wherein the first end of the transmission unit body is external to the second rod body;

at least one linking element having one end pivotally connected with the first rod body and another end pivotally connected with the sliding element; and a crimping portion connected with the second end of the transmission unit body, with the crimping portion located intermediate the abutting member and the first end of the transmission unit body;

wherein when the adjustable portion is adjusted, the crimping portion is moved, thereby changing the distance between the crimping portion and the abutting element.

2. The crimping tool as claimed in claim 1, wherein the transmission unit body comprises a screw rod, wherein the sliding element comprises a first threaded hole, and wherein the sliding element is spirally adjustably connected with the transmission unit body by extending the screw rod through the first threaded hole.

3. The crimping tool as claimed in claim 2, wherein the crimping portion comprises a second threaded hole, and wherein the crimping portion is spirally adjustably connected with the transmission unit body by extending the screw rod through the second threaded hole.

4. The crimping tool as claimed in claim 3, further comprising an elastic element pivotally connected with the at least one linking element, with the elastic element providing an elastic force returning the first rod body and the second rod body to an original position after the first rod body and the second rod body are pressed together.

5. The crimping tool as claimed in claim 1, wherein the at least one bump comprises two bumps on a left side and a right side of the sliding element, wherein the sliding element is slidably connected with the at least one guiding groove through one of the two bumps, and wherein the at least one linking element is pivotally connected with the sliding element through another of the two bumps.

6. The crimping tool as claimed in claim 1, wherein the crimping portion comprises an F-type coaxial connector crimping portion, a BNC-type coaxial connector crimping portion, an RCA-type coaxial connector crimping portion or an IEC-type coaxial connector crimping portion.

7. The crimping tool as claimed in claim 1, wherein the crimping portion and the transmission unit body are integrally formed.

8. The crimping tool as claimed in claim 1, wherein the crimping portion is detachably and adjustably connected with the second end of the transmission unit body.

9. The crimping tool as claimed in claim 1, wherein the sliding element is substantially cylindrical.

10. The crimping tool as claimed in claim 1, wherein the second rod further comprises a buckle, with the buckle pivotally connected with the second rod body for buckling the first rod and the second rod together.

11. A crimping tool comprising:

a first rod including two first rod bodies;

a second rod including a second rod body and an abutting element, with the second rod body including two guiding grooves, a first end and a second end, with the second end including an opening, and with the abutting element disposed on the first end of the second rod body;

a transmission unit comprising:

a transmission unit body having a first end and a second end, with the transmission unit body extended through the opening of the second end of the second rod body;

a sliding element adjustably connected with the transmission unit body and moveable on the transmission unit body, with the sliding element including two bumps, with the sliding element slidably connected with the two guiding grooves through the two bumps, and with the two first rod bodies being connected with the sliding element through the two bumps; and an adjustable portion disposed on the first end of the transmission unit body, wherein the first end is external to the second rod body;

two linking elements having one end pivotally connected with the two first rod bodies and another end pivotally connected with the second rod body; and a crimping portion connected with the second end of the transmission unit body;

wherein when the adjustable portion is adjusted, the crimping portion is moved, thereby changing the distance between the crimping portion and the abutting element.

12. A crimping tool comprising:

a first rod including a first rod body having a first end defining a first opening;

a second rod including a second rod body and an abutting element, with a first end of the second rod body pivotally connected with the first end of the first rod body, with the first end of the second rod body including a second opening overlapping the first opening, and with the abutting element disposed on a second end of the second rod body;

a transmission unit comprising:

a transmission unit body having a first end and a second end, with the transmission unit body extended through the second and first openings of the second rod body and the first rod body, with the first end of the transmission unit body located outside the first and second openings opposite to the second end of the second rod body;

a sliding element adjustably connected with the transmission unit body and moveable on the transmission unit body; and an adjustable portion disposed on the first end of the transmission unit body, wherein the first end of the transmission unit body is external to the second rod body;

a linking element having one end pivotally connected with the first rod body and another end pivotally connected with the transmission unit body; and a crimping portion connected with the second end of the transmission unit body;

wherein when the adjustable portion is adjusted, the crimping portion is moved, thereby changing the distance between the crimping portion and the abutting element.

* * * * *